US010118798B2

(12) United States Patent
Kattainen

(10) Patent No.: US 10,118,798 B2
(45) Date of Patent: Nov. 6, 2018

(54) MONITORING CONDITION OF SAFETY SYSTEM FOR ELEVATOR

(71) Applicant: KONE Corporation, Helsinki (FI)

(72) Inventor: Ari Kattainen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 370 days.

(21) Appl. No.: 14/876,958

(22) Filed: Oct. 7, 2015

(65) Prior Publication Data

US 2016/0107862 A1 Apr. 21, 2016

(30) Foreign Application Priority Data

Oct. 21, 2014 (EP) ..... 14189698

(51) Int. Cl.
*B66B 1/34* (2006.01)
*B66B 5/00* (2006.01)

(52) U.S. Cl.
CPC ..... *B66B 5/0031* (2013.01); *B66B 5/005* (2013.01); *B66B 5/0056* (2013.01)

(58) Field of Classification Search
CPC ..... B66B 5/0031; B66B 5/005; B66B 5/0056
USPC ..... 187/247, 391, 316, 317, 343, 344, 351, 187/357, 393, 394
See application file for complete search history.

(56) References Cited

U.S. PATENT DOCUMENTS 4,750,591 A * 6/1988 Coste ..... B66B 5/0006 187/391
5,057,699 A * 10/1991 Spence ..... G05B 19/0423 307/98
5,487,448 A * 1/1996 Schollkopf ..... B66B 5/0006 187/247
5,727,657 A 3/1998 Foelix
6,202,797 B1 * 3/2001 Skolnick ..... A41D 13/00 187/279
6,223,861 B1 * 5/2001 Sansevero ..... B66B 13/22 187/316
6,603,398 B2 * 8/2003 Tinone ..... B66B 13/22 187/316
7,832,526 B2 * 11/2010 Sirigu ..... B66B 5/0056 187/294
8,261,885 B2 * 9/2012 Ketoviita ..... B66B 5/0043 187/314
8,490,755 B2 * 7/2013 Lindberg ..... B66B 13/22 187/314
9,061,863 B2 * 6/2015 Birrer ..... B66B 13/22
9,422,135 B2 * 8/2016 Rogers ..... B66B 5/0018
9,448,273 B2 * 9/2016 Kattainen ..... B66B 5/0093

FOREIGN PATENT DOCUMENTS

DE 10 2005 060 839 A1 6/2007
JP 9-278307 A 10/1997
WO WO 2010/122211 A1 10/2010

* cited by examiner

*Primary Examiner* — Anthony Salata

(74) *Attorney, Agent, or Firm* — Birch, Stewart, Kolasch & Birch, LLP

(57) ABSTRACT

According to few examples a safety system, a method and a computer program for an elevator safety system is provided. A first switch configured to detect a first position of a safety device of an elevator. A second switch configured to detect a second position of the safety device. A controller configured to monitor a change of a state of the first switch and a change of a state of the second switch.

11 Claims, 5 Drawing Sheets

MONITORING CONDITION OF SAFETY SYSTEM FOR ELEVATOR

TECHNICAL FIELD

The present invention relates to an elevator system. In particular, the present invention relates to a safety system of an elevator.

BACKGROUND

An upper and lower space of an elevator shaft must be equipped with an adequate safety space. This is the case also in so called machine-room-less elevators having elevator drive and other serviceable components mounted inside elevator shaft.

Sufficient upper and lower space is protecting maintenance personnel during maintenance operations. It additionally protects unauthorized intruders, for example for being compressed against the elevator shaft.

The protecting space can, subject to certain conditions, be implemented by a technical safety device instead of a fixed pithole at the bottom of the shaft or a fixed protection room at the top of the shaft. However, an operation of the safety device should be ensured and secured. For example, that the safety device is not jammed, or that it is in a correct position.

A safety device for establishing a temporary safety space in elevator shaft is known from international publication no. WO 2010/122211 A1. This safety device may be implemented with relays, for example.

Publications U.S. Pat. No. 5,727,657A, DE 102005060839A1, JPH09278307A discuss information that can be regarded as useful for understanding the background of the invention.

The present invention is targeted to an improvement for such a safety device.

SUMMARY

An objective of the present invention is to disclose a safety solution with improved supervision logic for establishing a temporary safety space.

According to few examples a safety system, a method and a computer program for an elevator safety system is provided. A first switch configured to detect a first position of a safety device of an elevator. A second switch configured to detect a second position of the safety device. A controller configured to monitor a change of a state of the first switch and a change of a state of the second switch.

An example of the safety system can be used to ensure that a safety device of the safety space of the elevator shaft is operating correctly. An example may also make it difficult to intentionally damage or render the safety device inoperable. An example of the safety system may ensure that a safety device is not over switched and/or that the switches may not have a stuck-at fault. Furthermore, the safety system may ensure that the wiring of the switches do not have short circuits. Even furthermore, the safety system may ensure that a safety device is not stuck, for example, as a result of corrosion.

At least one of the afore-mentioned implementation examples offers one or more solutions to the problems and disadvantages of known prior art. Other technological benefits of the present invention become evident to a person skilled in the art from the following description and the claims. The numerous examples of implementing the present invention achieve only a part of the presented advantages. None of the advantages is critical to the examples of implementation. Any required embodiment can technically be combined with any other required embodiment. The examples represent only a few advantageous embodiments and they do not limit the idea of the invention that can be implemented even in other manners within the framework of the claims presented further below.

BRIEF DESCRIPTION OF THE DRAWINGS

The attached figures illustrate examples of embodiments of the present invention, and together with the above general description and the detailed current embodiments help explain, by way of examples, the principles of the invention.

DETAILED DESCRIPTION

Figure 1:
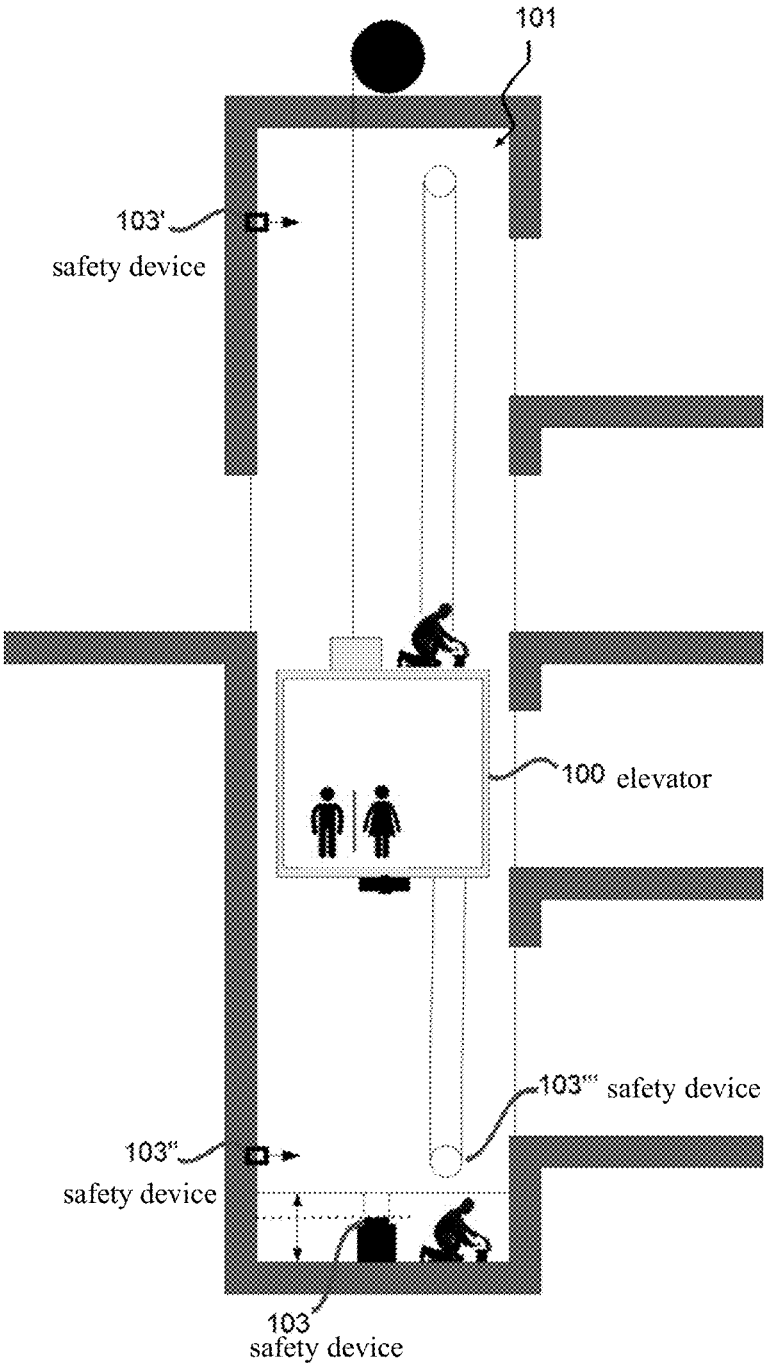
FIG. 1 is a schematic cross section of an elevator shaft in accordance with an embodiment.

In the example of FIG. 1, a safety system of an elevator 100 is illustrated. The elevator 100 runs within an elevator shaft 101. The safety system can ensure safe operation of the elevator 100 and/or the elevator shaft 101. FIG. 1 shows examples of a safety device 103. The safety device 103 may be configured to establish temporary safety space for maintenance of the elevator 100. Examples of the safety device 103,103',103",103''' include temporary safety spaces rendering devices. These may be pivotable or movable buffers, slideable elements in the shaft 101. Furthermore the safety device 103 may be a gripper gripping the car. Even furthermore the safety device 103 may be an over speed limiter of the car. The safety device 103 may be inside the shaft 101 or constructed at least partly outside it. Additionally the safety device 103 may be a door of the elevator 100 in the safety use, a door brake, maintenance drive equipment. Purpose of the safety device 103 is to ensure that people, especially the maintenance people, does not get in danger when the elevator 100 operates or starts to operate. The safety device 103 has two operational stages, for example, two positions: The safety device 103 extended and retracted, open and close, on and off, depending on the use purpose of the safety device 103. FIG. 1 shows the safety device 103 being retracted having a safety zone by a horizontal dashed line, and the safety device 103 being extended (illustrated with dashed safety device having a safety zone by a horizontal line.

Typically a safety device 103 has two switches 111,112. They are used to monitor the technical safety device 103, to detect the two operation stages of the safety device 103. For example, one of the switches 111 is configured to ensure that the safety device 103 is fully retracted, for example in the normal operation mode 300. The second switch 112 is configured to ensure that the safety device 103 is fully extended, for example in the maintenance mode 301. The switches 111,112 are configured to monitor two operation stages of the safety device 103; extended/retracted, open/close, on/off, etc.

In an example, the maintenance operation mode 301 situations can be safely reset. The elevator can be reset to a normal operation mode 300 only, when a safety system verifies that the safety device 103 operates or has operated correctly. This is verified by running a monitoring program for a sequence of changes of switches 111,112 of the safety device 103.

By monitoring whether a safety device 103 is fully retracted and/or fully extended, the safety system can ensure that the safety device 103 is nor rusted or that the safety device 103 is not over switched by other ways. Advantageously, the safety system may ensure that the safety device 103 is not over-switched. The safety system may ensure that the switches 111 do not have a stuck-at fault. For example, that the switch 111,112 is not fixed to the close position. The safety system may ensure that the switch 111 wiring does not contain short circuits. The safety system may ensure that the safety device 103 is not mechanically stuck, for example as a result of corrosion.

Switches 111,112 may, for example, be traditional switched, force switches or safety contacts, for example with direct opening action, or even switch clusters having several switches, or a combination of these. A switch 111,112 is configured for detecting an end position of the safety device 103. A switch cluster or a force switch may be used or even a single switch can be used. This may reduce costs and complexity of the safety system. Because a controller 20 is able to control the change of the state of the switch 111,112 the known force switch or group of switches can be replaced by an ordinary single switch. The controller 200 can detect the condition of the switch 111,112.

Figure 2:
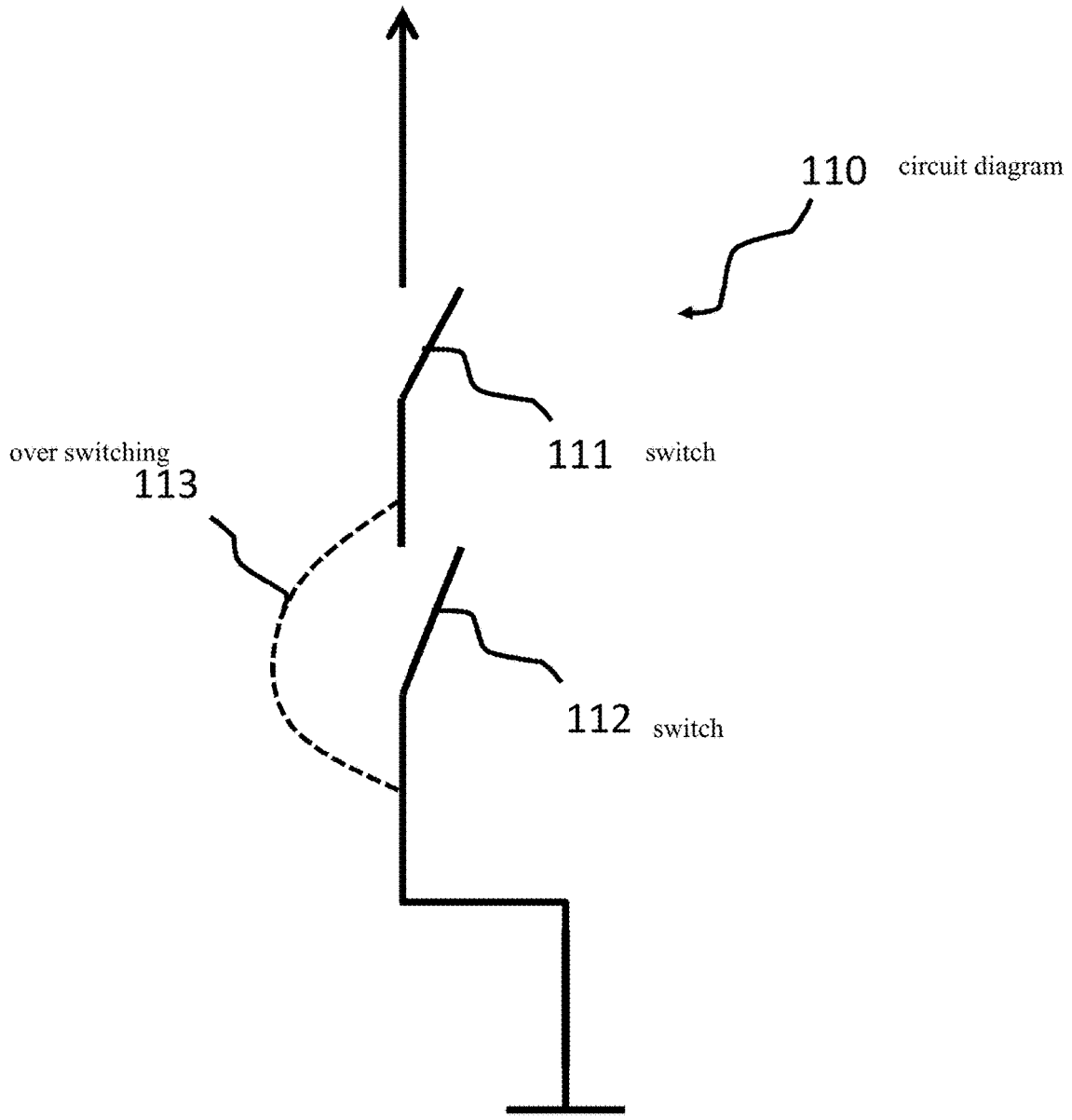
FIG. 2 is an example of schematic circuit diagram of switching.

FIG. 2 shows a schematic circuit diagram 110 of switches 111,112. In FIG. 2 a safety circuit is show having the switches 111,112. When the safety device 103 is in a fully retracted position or in a fully extended position, the respective switch 111,112 conducts electricity within an on-position. The switches 111,112 do not conduct electricity when they are in the off position. If a cable, between the switches 111,112 and controller 200, breaks, has disconnections, or the circuit is interrupted for any other reasons, then the switch 111,112 drops to the logical off position. This may enhance security, reliability and provides an advantage. If there is a disconnection in the electricity by any means, the switch drops to the off state. This change of the state of the switch 111,112 can be detected by the controller 200. The controller 200 can act accordingly, for example not to enter into the normal operation mode 301. If the controller 200 does not recognize the correct changes of the states of the switches 111,112, the elevator 100 remains in the maintenance mode 301. Before the maintenance mode 301 can be reset, the controller 20 is configured to perform the safety sequence. The safety sequence concerns appropriate sequence of the changes of the states of the switches 111,112. Opening of a switch 111, 112 has the effect that current supply to elevator main contactor is interrupted, which causes opening of the main contactor. Opening of the main contactor brings the elevator to a safety state by applying mechanical brakes and interrupting power supply to elevator drive.

An example of an over switching 113, or interchangeably in this disclosure referred to as an over switch, is shown in FIG. 2 by a dashed curved line. The over switch 113 is an inappropriate switching. For example a maintenance person may inappropriately short circuit the switch 112 during maintenance operation. The safety system can advantageously detect the over switch 113 by running the sequence of changes of the states of the switches 111,112.

Figure 3:
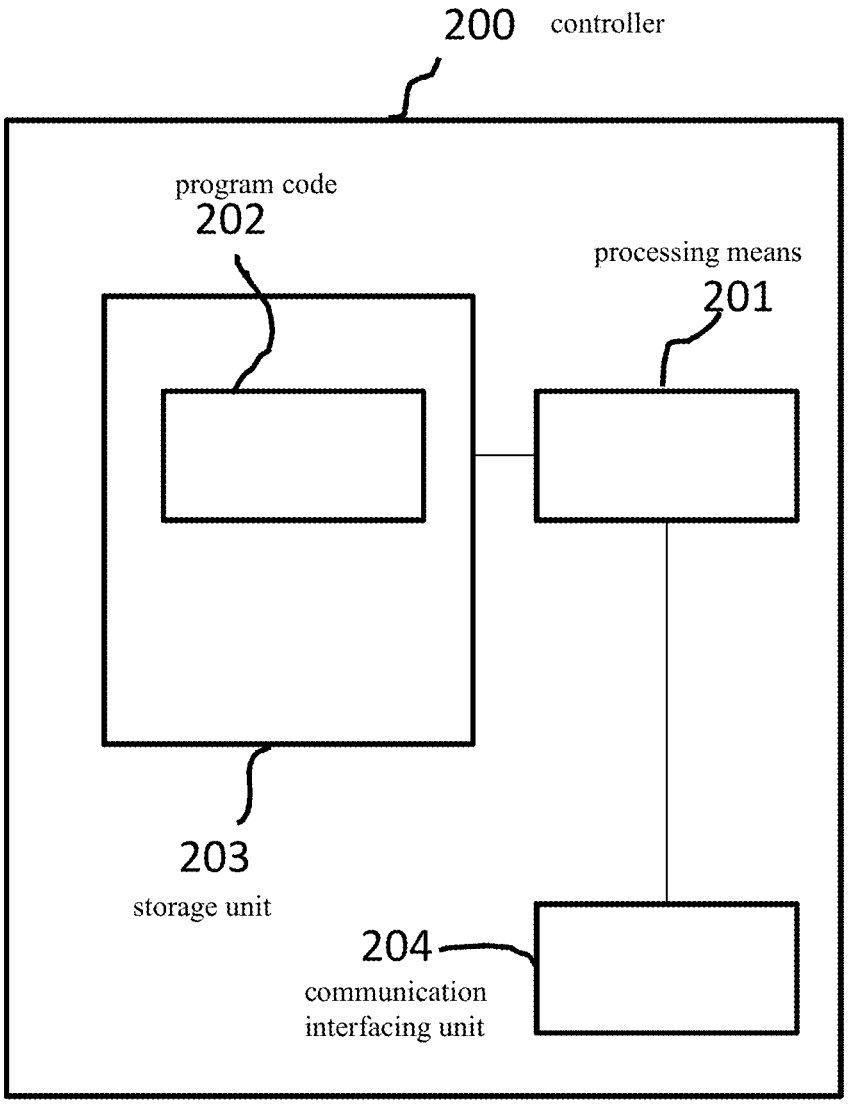
FIG. 3 is a schematic diagram of a controller according to an embodiment.

A schematic diagram of the controller 200 according to an embodiment is shown in FIG. 3. The controller 200 can be a computing device in the elevator shaft 101 or in the elevator 100. The controller 200 may include a processing means 201 such as a microprocessor or Application Specific Integrated Circuit, ASIC, a storage unit 203 and a communication interfacing unit 204. The storage unit 203 may be any data storage device that can store a program code 202, accessed and executed by the processing means 201. Examples of the storage unit 203 include but are not limited to read-only memory, ROM, flash memory, random-access memory, RAM, CD-ROM/DVD-ROM, magnetic tape, hard disk and optical data storage device. The communication interfacing unit 204 may be a transceiver and is used to transmit and receive signals, for example, messages or packets, according to processing results of the processing means 201. The functionality described herein can be performed, at least in part, by one or more hardware logic component.

Figure 4:
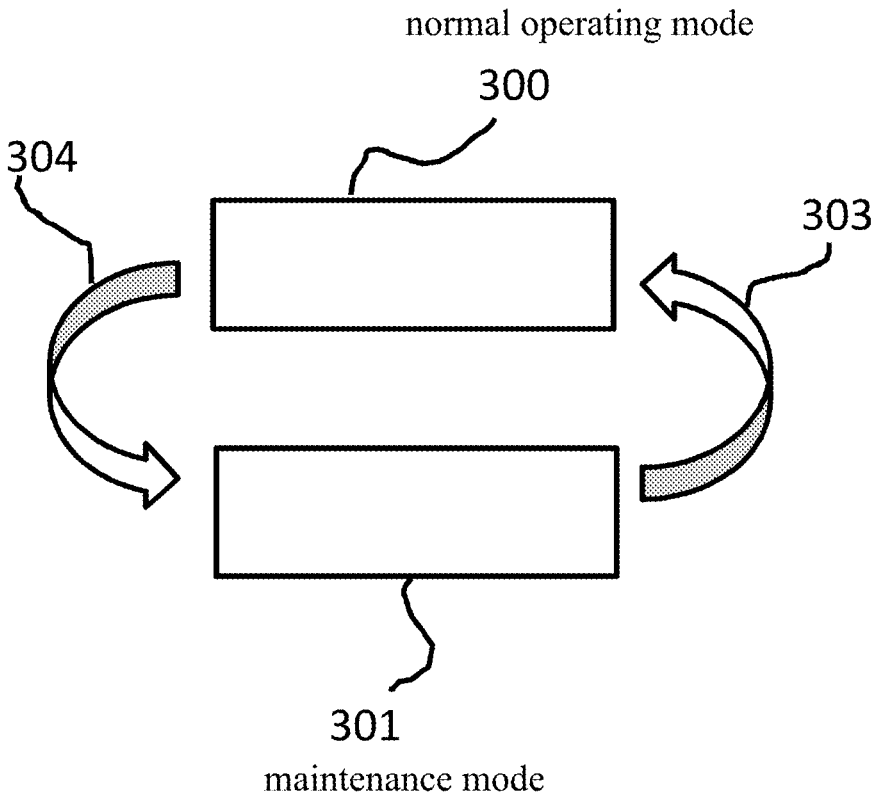
FIG. 4 is a schematic flow chart of operation modes of the elevator in accordance with an embodiment.

Referring to FIG. 4, the process is utilized in the controller 200 shown in FIG. 3, for controlling operation modes of the elevator 100. The process of FIG. 4 may be compiled into the program code 202. The process includes the following steps:

Step 300: Normal operation mode.

Step 301: Maintenance mode.

Step 303: A change of the mode from maintenance mode 301 to normal mode 300.

Step 304: A change of the mode from normal mode 300 to maintenance mode 301.

According to the process, when the normal operation mode 300 applies, the elevator 100 is used ordinarily for the flow of the people and goods. The maintenance mode 301 is used for the safe maintenance of the elevator 100 or the elevator shaft 101. The maintenance mode 301 may relate to a maintenance person being situated in the maintenance zone of the elevator shaft 101. For example, a person in pit and/or a person on car roof situations. The elevator 100 may be driven outside the maintenance zone, which is secured for maintenance person. The maintenance person may be also situated in a fixed protection room at the top of the elevator shaft 101. Consequently, the elevator 100 or the elevator shaft 101 can be safely fixed or inspected during the maintenance mode 301. When a command to enter the maintenance mode 301 from the normal operation mode 300 is received, a change of the mode 304 is processed. When a command to enter the normal operation mode 300 from the maintenance mode 301 is received, a change of the mode 303 is processed. In an embodiment, a sequence of steps, as for example illustrated in FIG. 4, needs to be processed within the change of the mode 303 prior to entering the normal operation mode 300. This can enhance security by ascertaining a correct operation of the safety device 103 of the elevator 100.

Figure 5:
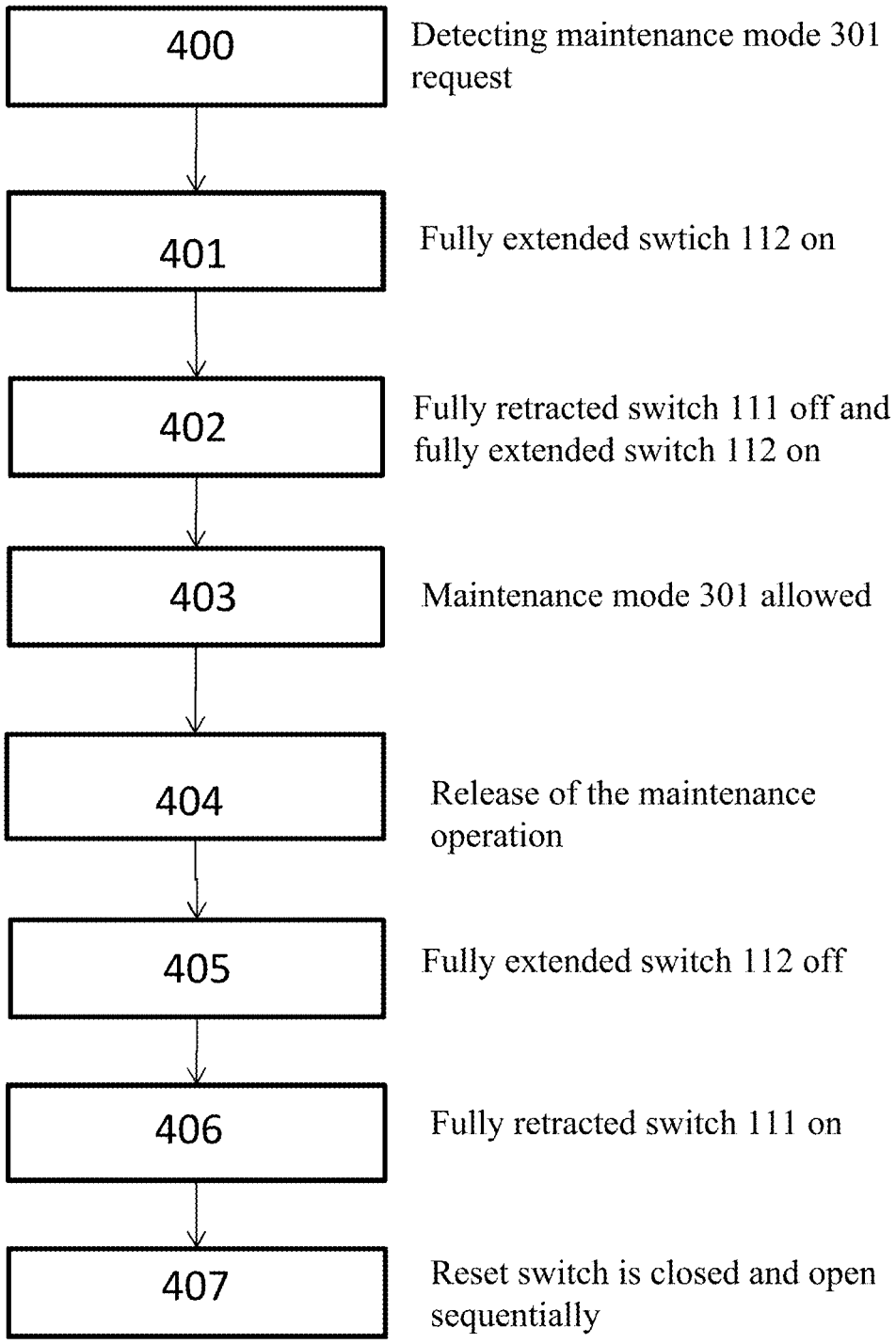
FIG. 5 is a schematic flow chart of sequence for entering the elevator to normal operation mode from the maintenance mode in accordance with an embodiment.

Referring to FIG. 5, the process is utilized in the controller 200 shown in FIG. 3, for controlling a safety and security of the operation of the safety device 103. The process may be compiled into the program code 202. The process includes the following steps:

Step 400: Detecting maintenance mode 301 request.

Step 401: Fully extended switch 112 on.

Step 402: Fully retracted switch 111 off and fully extended switch 112 on.

Step 403: Maintenance mode 301 allowed.

Step 404: Release of the maintenance operation.

Step 405: Fully extended switch 112 off.

Step 406: Fully retracted switch 111 on.

Step 407: Reset switch is closed and open sequentially.

According to process, in a step 400 there is being detected a need for the maintenance mode 301. For example, there is a person in the pit or a person on the car roof of the elevator. Alternative this can be detected after powering up the elevator 100, wherein the mode is already at the maintenance mode 301. An identification of the maintenance mode 301 can be detected by detection means detecting intrusion into elevator shaft, etc.

A fully extended switch 112 is in an on position in the step 401. When the maintenance mode 301 identification has been made, the safety device 103, constituting the protective safety space of the elevator 100, has to enter the safety positions. This position is identified by the fully extended switch 112, which moves into a conductive state, when the safety device 103 has been turned into operating position and is in a working order. This is to ensure that the safety device 103 is not faulty or malfunction.

In the step 402, a fully retracted switch 111 is in the off position, while the fully extended switch 112 is in the on position. The fully retracted switch 111 must not be at the on position at the same time, when the safety device 103 is fully extended. This is to ensure that the fully retracted switch 111 is not over switched into the on position. The possible on position of the fully retracted switch 111, in this situation, is faulty.

In the step 403, a maintenance use of the elevator 100 is now permitted. For example, the alert may be due to a person entering a limit area of the maintenance use mode 301. Normal operation 300 is blocked in the step 403. The maintenance service drive is possible. The safety device 103 is at the fully extended position.

In the step 404, a person leaves the maintenance area and switches all safety devices off. He also releases all stop devices and turns the safety device 103 to a retracted position, as well as turns off the maintenance service drive switch. The maintenance mode 301 is still on. Start-up of elevator mechanism has been blocked.

In the step 405, the fully extended switch 112 is in the off position. The safety device 103 must move away from the fully extended position. This is to ensure that the fully extended switch 112 is not over switched.

The fully retracted switch 111 is in the on position in the step 406. The safety device 103 must be moved to the normal operating position. The fully retracted switch 111 over switching was monitored the step 402.

In the step 407, a contact of a reset switch is closed and then opened. The maintenance mode 301 can now be reset, because of the operations sequence of the steps 400-406 ensures the following:

1) The safety device 103 is able to enter the fully extended position.
2) The fully retracted switch 111 is not over switched.
3) All terms for the identification of the maintenance mode 301 are off.
4) The fully extended switch 112 is not over switched.
5) The safety device 103 is able to enter the fully retracted position.
6) The reset switch changes a state.

For a person skilled in the art, it is obvious that numerous modifications and variations can be made to the equipment and method. Other embodiments and exemplary implementations become evident to a person skilled in the art on the basis of the specification and practice related to the equipment and method described. The purpose is that the specification and the examples be regarded only as exemplary, so that the following patent claims and their equivalents show the actual scope of protection.

The invention claimed is:

1. A safety system of an elevator, comprising:

a safety device provided in an elevator shaft of the elevator and configured to establish a temporary safety space during a maintenance mode of the elevator by limiting travel of an elevator car when in a fully extended position, the safety device including:

a first switch that is configured to detect a first end position of the safety device, wherein in the first end position, the safety device is in a fully retracted position; and a second switch, different from the first switch, wherein the second switch is configured to detect a second end position of the safety device, wherein in the second end position, the safety device is in the fully extended position; and a controller configured to:

monitor a change of a state of the first switch and a change of a state of the second switch, monitor a sequence or an order of the changes of the states, wherein the sequence or the order is desired or non-desired, and block a drive of the elevator if the sequence or the order is non-desired.

2. The safety system of the elevator of claim 1, wherein the states comprise an on state and an off state, and wherein the first and second switches are configured to conduct electricity at the on state.

3. The safety system of the elevator of claim 1, wherein the first and second switches are configured not to conduct electricity at the off state.

4. The safety system of the elevator of claim 1, wherein the first switch is configured to verify that the safety device is retracted.

5. The safety system of the elevator of claim 1, wherein the second switch is configured to verify that the safety device is extended.

6. The safety system of the elevator of claim 1, wherein if the controller determines that a circuit of either of the first and second switches is interrupted or the safety device is neither fully retracted or fully extended, the controller is configured to enter or maintain the elevator within the maintenance mode or to block a drive of the elevator.

7. A method of a safety system of an elevator, comprising the steps of:

providing a safety device in an elevator shaft of the elevator, wherein the safety device establishes a temporary safety space during a maintenance mode of the elevator by limiting travel of an elevator car when in a fully extended position, the safety device including:

a first switch that detects a first end position of the safety device, wherein in the first end position, the safety device is in a fully retracted position; and a second switch, different from the first switch, that detects a second end position of the safety device, wherein in the second end position, the safety device is in the fully extended position;

monitoring, by a controller, a change of a state of the first switch and a change of a state of the second switch;

monitoring, by the controller, a sequence or an order of the changes of the states, wherein the sequence or the order is desired or non-desired; and blocking, by the controller, a drive of the elevator if the sequence or the order is non-desired.

8. A computer program product embodied on a non-transitory computer readable medium, the computer program product comprising programmable means configured to cause a computer to perform the steps of the method of claim 7.

9. The safety system of the elevator of claim 1, wherein the first and second switches do not to conduct electricity in their respective off states.

10. The method of claim 7, wherein the first and second switches do not to conduct electricity in their respective off states.

11. The method of claim 7, wherein if the controller determines that a circuit of either of the first and second switches is interrupted or the safety device is neither fully retracted or fully extended, the controller enters or maintains the elevator within the maintenance mode or blocks a drive of the elevator.

* * * * *